US006332935B1

(12) United States Patent
Gorman et al.

(10) Patent No.: US 6,332,935 B1
(45) Date of Patent: Dec. 25, 2001

(54) PROCESSING OF TITANIUM-ALLOY BILLET FOR IMPROVED ULTRASONIC INSPECTABILITY

(75) Inventors: Mark D. Gorman, West Chester, OH (US); Andrew P. Woodfield, Cold Spring, KY (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/534,662

(22) Filed: Mar. 24, 2000

(51) Int. Cl.[7] ..... C22F 1/18
(52) U.S. Cl. ..... 148/508; 148/671
(58) Field of Search ..... 148/670, 671, 148/417, 508

(56) References Cited

U.S. PATENT DOCUMENTS 3,470,034 * 9/1969 Kastanek et al. ..... 148/671
5,277,718 1/1994 Paxson et al. ..... 148/671

FOREIGN PATENT DOCUMENTS 63206457 8/1988 (JP) .
08049053 2/1996 (JP) .

OTHER PUBLICATIONS

Database INSPEC, Institute of Electrical Engineers, Stevenage, GB; Pam JH et al.: "Influence of different forging processes on the ultrasonic response in titanium alloys TC6 and TC11". XP–002171168 (Abstract) no date.

* cited by examiner

*Primary Examiner*—Scott Kastler
(74) *Attorney, Agent, or Firm*—Andrew C. Hess; David L. Narciso

(57) ABSTRACT

A starting workpiece of a titanium-base alloy having a temperature-composition phase diagram with a beta region and an alpha-beta region separated by a beta transus temperature is processed by first forging the starting workpiece at a first temperature in the beta region to form a billet, thereafter second forging the billet at a second temperature in the alpha-beta region, thereafter third forging the billet at a third temperature in the beta region, thereafter fourth forging the billet at a fourth temperature in the alpha-beta region so that the step of fourth forging accomplishes a reduction in cross-sectional area of from about 5 to about 40 percent, and thereafter ultrasonic testing the billet. The beta-region third forging step combined with a relatively small reduction during the alpha-beta-region fourth forging step produce a microstructure that is conducive to ultrasonic inspection with minimal interference from noise.

20 Claims, 3 Drawing Sheets

PROCESSING OF TITANIUM-ALLOY BILLET FOR IMPROVED ULTRASONIC INSPECTABILITY

This invention relates to the processing of titanium alloys, and, more particularly, to the processing of billets of titanium-base alloys to permit low-noise ultrasonic inspection at the conclusion of the processing.

BACKGROUND OF THE INVENTION

Large articles of alpha-beta titanium-base alloys may be produced by casting the titanium alloy into a mold and mechanically working the cast ingot to a smaller size termed a billet. The mechanical working is typically accomplished by forging (although not the forging approach of the present invention) to accomplish the size reduction. After the mechanical reduction, the billet is further shaped, for example by additional forging and/or machining, to the final desired shape.

Large titanium-alloy forgings are often used for aerospace parts which must meet stringent requirements before they may be placed into service. For this reason, between the forging operation and the final shaping operation the billet is inspected ultrasonically to assess whether its quality is suitable for the final processing and eventual service. The ability of the ultrasonic inspection to detect flaws is limited by the noisiness inherent in the ultrasonic testing. In many cases, the noisiness results from interference from the material structure rather than from the testing technique, the electronic capabilities, and similar sources.

Several approaches have been utilized to improve the ultrasonic testing of the billet. In one, the ultrasonic inspection procedures have been improved but are not fully successful in avoiding interference by noise. In another approach, as described in U.S. Pat. No. 5,277,718, there is a heat treatment after the forging but before ultrasonic inspection. This heat treatment, while improving inspectability, may interfere with the subsequent processing of the billet.

There is a need for an improved approach to the processing of billets of alpha-beta titanium alloys, particularly those billets that are to be subsequently beta-processed after the billet stage. The improved approach should permit ultrasonic inspection of the billets with low interference from noise, and also be compatible with subsequent processing of the billets into articles. The present invention fulfills this need, and further provides related advantages.

BRIEF SUMMARY OF THE INVENTION

The present invention provides a method for processing workpieces of alpha-beta titanium-base alloys, particularly those that are to be beta-processed subsequent to the billet stage. The approach results in a billet that is readily suited both for ultrasonic inspection and for further processing to useful articles. Relatively large billets may be forged by this approach. The microstructure of the finished billet is selected to minimize noise and undesirable reflections in ultrasonic testing, so that ultrasonic testing is optimally performed to evaluate the interior structure of the billet. The process of the invention is readily and economically performed using available machinery and furnaces.

A processing method is practiced on a starting workpiece of a titanium-base alloy having a temperature-composition phase diagram with a beta region and an alpha-beta region separated by a beta transus temperature. The method includes first forging the starting workpiece at a first temperature above the beta transus temperature in the beta region to form a billet, thereafter second forging the billet at a second temperature below the beta transus temperature in the alpha-beta region, and thereafter third forging the billet at a third temperature above the beta transus temperature in the beta region. Optionally, the billet is quenched, preferably by water quenching, after the third forging step. Optionally, the billet may be annealed and/or further worked by beta-processing after the third forging step. The billet is typically ultrasonically tested after the third forging step in this embodiment. The cross sectional shape of the billet may be varied during the forging process to obtain optimal results.

In a further embodiment of the invention, there is an additional step, after the step of third forging, of fourth forging the billet at a fourth temperature below the beta transus temperature in the alpha-beta region. The result is more-desirable mechanical properties for subsequent processing. The step of fourth forging preferably accomplishes a reduction in cross-sectional area of the billet of up to about 40 percent, more preferably from about 5 to about 40 percent, and most preferably from about 5 to about 15 percent. Optionally, the forged billet may be annealed after the fourth forging step. Ultrasonic testing is performed after the fourth forging step in this embodiment. Optionally, the billet may be further worked by beta-processing after the ultrasonic testing. As in the prior embodiment, the shape of the billet may be varied during the course of the forging process.

The approach of the invention produces a billet with randomly oriented interfaces between crystallographically aligned regions of transformed beta structure. With relatively little or no deformation after the third forging step in the beta region, this microstructure is retained. This microstructure has been found to be favorable to produce large billets that may be ultrasonically inspected with relatively low noise. While the use of no fourth forging step in the alpha-beta region is within the scope of the invention and yields very low noise in ultrasonic testing, there may optionally be a small reduction in cross-sectional area by alpha-beta forging in the fourth step to impart additional ductility to the forging so that it may be more readily handled in a production environment and in further processing.

The present invention thus provides a technique for producing a billet of an alpha-beta titanium alloy that is readily inspected by ultrasonic techniques and is suitable for further processing into a wide range of articles. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
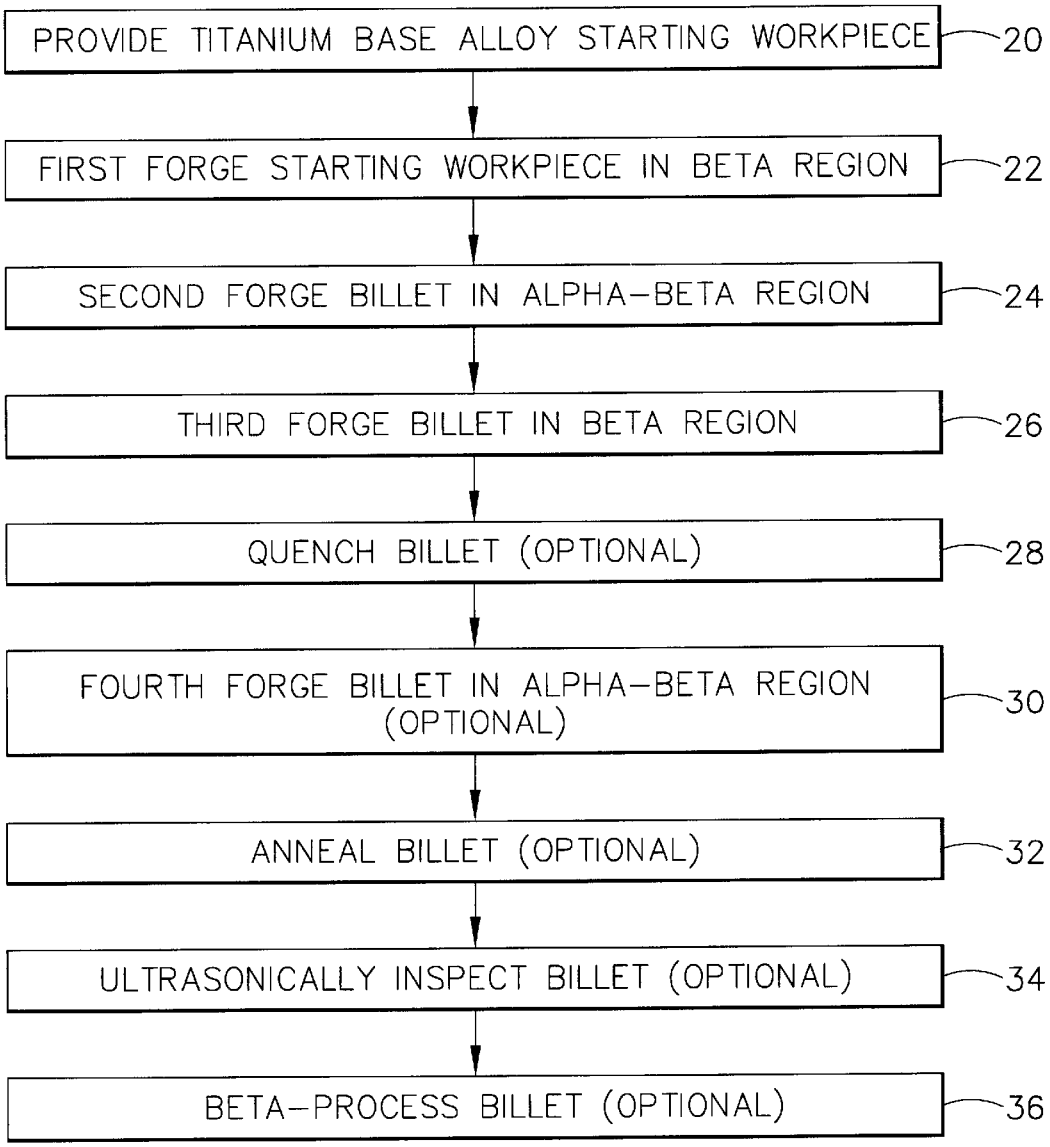
FIG. 1 is a block flow diagram covering the preferred embodiments of the method of the invention.
Figure 2:
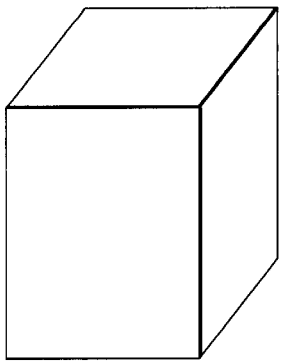
FIG. 2 is a schematic drawing of a rectangular workpiece.
Figure 3:
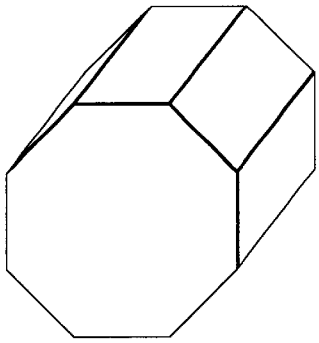
FIG. 3 is a schematic drawing of a prismatic workpiece.
Figure 4:
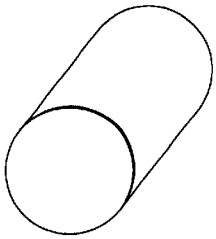
FIG. 4 is a schematic drawing of a right circular cylindrical workpiece.

FIG. 1 illustrates a method for processing a billet of a titanium-base alloy in accordance with the invention. A starting workpiece of a titanium-base alloy capable of forming mixtures of alpha (α) and beta (β) phases, commonly called an alpha-beta (α-β) titanium-base alloy, is furnished, numeral 20. The starting workpiece may be in an as-cast (commonly termed ingot) or as-cast-plus-worked form. As a starting workpiece or as a billet at any stage of the processing, the workpiece may have any operable shape. Examples of rectangular, prismatic, and right-circular cylindrical shapes for the workpiece are illustrated in FIGS. 2–4.

Figure 5:
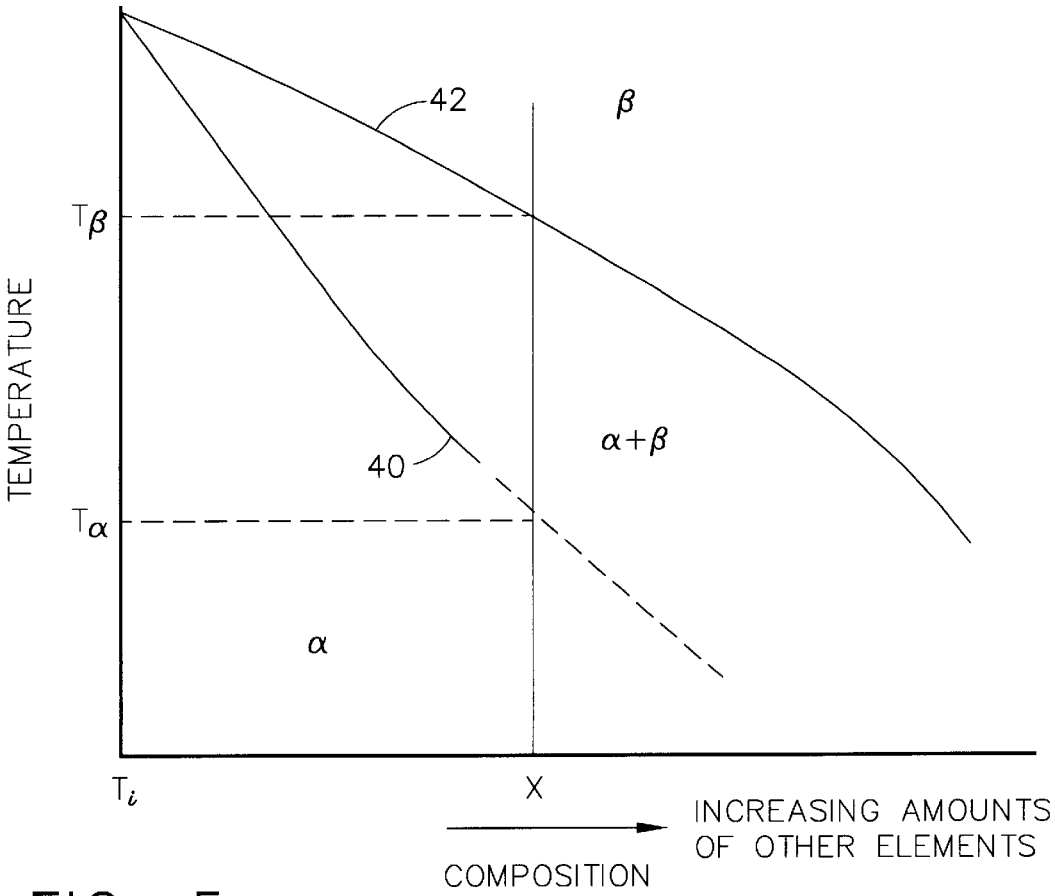
FIG. 5 is a schematic temperature-composition phase diagram for an alpha-beta titanium alloy with a downwardly sloping beta transus.

Alpha (α) phase is a hexagonal close packed (HCP) phase thermodynamically stable at lower temperatures, beta (β) phase is a body centered cubic (BCC) phase thermodynamically stable at higher temperatures, and a mixture of alpha and beta phases is thermodynamically stable at intermediate temperatures. FIG. 5 is an idealized temperature-composition equilibrium phase diagram for such an alpha-beta titanium-base alloy. Discussion of processing in terms of features of the temperature-composition phase diagram allows a wide range of alloy compositions to be discussed in common terms. The alpha-beta titanium-base alloy is "titanium base", meaning that it has more titanium than any other element. In a typical case, the alpha-beta titanium-base alloy, whose composition is represented by a vertical line X in FIG. 5, has more than about 70 weight percent titanium, with the balance other elements. In the temperature-composition phase diagram of FIG. 5, there is an alpha phase region at low temperature, a beta phase region at high temperature, and an alpha-plus-beta phase region at intermediate temperature. An alpha transus line 40 separates the alpha phase region from the alpha-plus-beta phase region, and a beta transus line 42 separates the alpha-plus-beta phase region from the beta-phase region. For any composition X, Tα is the temperature at which the vertical composition line X intersects the alpha transus line 40, and Tβ is the temperature at which the vertical composition line X intersects the beta transus line 42.

Examples of alpha-beta titanium alloys having such a temperature-composition phase diagram operable with the present invention include Ti-17, having a nominal composition, in weight percent, of about 5 percent aluminum, about 2 percent tin, about 2 percent zirconium, about 4 percent molybdenum, and about 4 percent chromium; Ti-6242, having a nominal composition, in weight percent, of about 6 percent aluminum, about 2 percent tin, about 4 percent zirconium, about 2 percent molybdenum, and about 0.08 percent silicon; Ti-6246, having a nominal composition, in weight percent, of about 6 percent aluminum, about 2 percent tin, about 4 percent zirconium, and about 6 percent molybdenum; Ti-62222, having a nominal composition, in weight percent, of about 6 percent aluminum, about 2 percent tin, about 2 percent zirconium, about 2 percent molybdenum, about 2 percent chromium, and about 0.25 percent silicon; Ti-64, having a nominal composition, in weight percent, of about 6 percent aluminum and about 4 percent vanadium; Ti-662, having a nominal composition, in weight percent of about 6 percent aluminum, about 6 percent vanadium, and about 2 percent tin; Ti-10-2-3, having a nominal composition, in weight percent, of about 10 percent vanadium, about 2 percent iron, and about 3 percent aluminum; Alloy 829, having a nominal composition, in weight percent, of about 5 percent aluminum, about 3.5 percent tin, about 3 percent zirconium, about 0.3 percent silicon, and about 1 percent niobium; and Alloy 685, having a nominal composition, in weight percent, of about 6 percent aluminum, about 5 percent zirconium, about 0.5 percent molybdenum, and about 0.25 percent silicon. The use of the invention is not, however, limited to these alloys.

The starting workpiece is first forged in the beta-phase region of the phase diagram, numeral 22, to an intermediate size. Forging is preferably performed by press forging between open dies. Press forging is preferred to impact-type forging, but impact-type forging may be used if desired. The workpiece is heated to the required temperature in the beta region (i.e., above Tβ) and then forged to the desired size. The first beta forging temperature is preferably from about 50° F. to about 700° F. above Tβ. The forged workpiece, now termed a billet, is thereafter optionally quenched, preferably by water quenching. The first forging may require multiple reheats to accomplish the required reduction.

The first-forged beta phase billet is thereafter second forged in the alpha-beta region, numeral 24. Forging is preferably performed by press forging between open dies. Press forging is preferred to impact-type forging, but impact-type forging may be used if desired. The workpiece is heated to the required temperature in the alpha-beta region (i.e., above Tα but below Tβ) and then forged to the desired size. The second-forging alpha-beta forging temperature is preferably from about 15° F. to about 125° F., most preferably about 50° F., below Tβ. The reduction in cross-sectional area in second forging is preferably at least about 20 percent. The second forging may require multiple rebeats to accomplish the required reduction.

The second-forged alpha-beta phase billet is thereafter third forged in the beta region, numeral 26. Forging is preferably performed by press forging between open dies. Press forging is preferred to impact-type forging, but impact-type forging may be used if desired. The workpiece is heated to the required temperature in the beta region (i.e., above Tβ) and then forged to the desired size. The third-forging beta forging temperature is preferably from about 25° F. to about 250° F., most preferably from about 50° F. to about 150° F., above Tβ. The reduction in cross-sectional area in third forging is at least about 20 percent. The billet workpiece is thereafter optionally quenched, numeral 28, preferably by water quenching, to minimize the grain-boundary alpha phase and improve the ease of randomizing the alpha phase in subsequent alpha-beta processing. Grain-boundary alpha phase is undesirable in the final product and is a potential reflector of the ultrasonic signal. The third forging may require multiple reheats to accomplish the required reduction.

The third-forged beta phase billet is thereafter optionally fourth forged in the alpha-beta region, numeral 30. Forging is preferably performed by press forging between open dies. Press forging is preferred to impact-type forging, but impact-type forging may be used if desired. The workpiece is heated to the required temperature in the alpha-beta region (i.e., above Tα but below Tβ) and then forged to the desired size. The fourth-forging alpha-beta forging temperature is preferably from about 15° F. to about 125° F., most preferably about 50° F., below Tβ. The fourth forging may require multiple reheats to accomplish the required reduction.

Optionally, the billet is annealed, numeral 32, after the third forging step 26 or after the fourth forging step 30. The annealing temperature and time depend upon the alloy being processed. However, annealing is typically performed at a temperature of from about 950° F. up to the beta transus 42, for a time of from about 1 to about 8 hours. The annealing for the most-preferred Ti-17 alloy is at about 1300° F. for about 4 hours.

The fourth forging step accomplishes a reduction in cross-sectional area of the billet of from more than 0 to about 40 percent, preferably from about 5 to about 40 percent, and most preferably from about 5 to about 15 percent. Where the reduction in area is zero, the fourth forging step is not performed, leaving the billet with a worked beta microstructure.

The billet is thereafter desirably ultrasonically inspected, numeral 34, by any operable approach. Examples of operable ultrasonic inspection techniques include various pulse-echo modes, such as A-scan, strip chart recording, or C-scan recording. The resulting ultrasonic test results are better than those that are obtained by other types of processing, for the reasons discussed in relation to FIG. 6.

Figure 6:
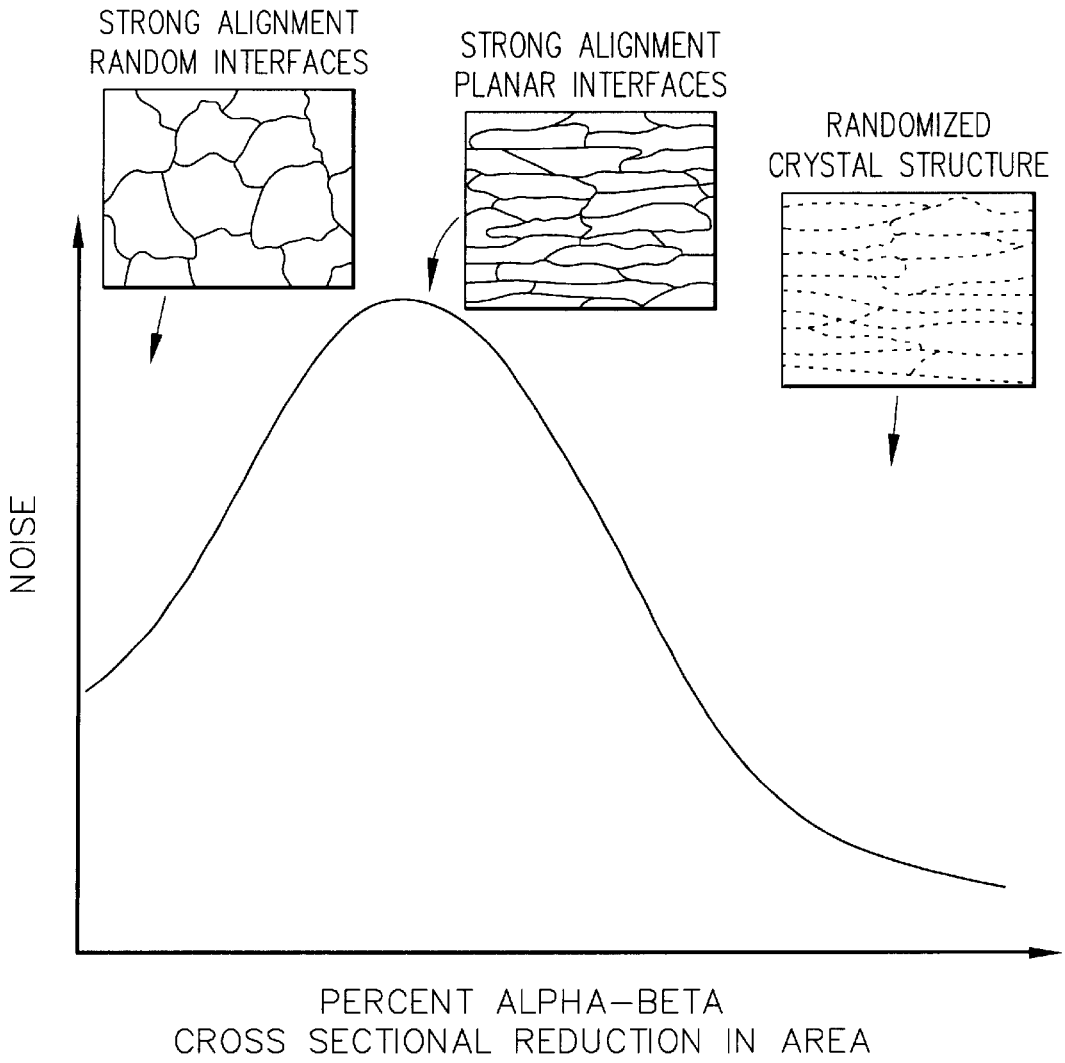
FIG. 6 is a schematic graph of noise during ultrasonic inspection as a function of the amount of final working in the alpha-beta region after a beta-region recrystallization, with the associated microstructures shown as insets.

The inventors have discovered that the material noise produced during ultrasonic testing is related to the microstructure of the billet, which in turn is related to the reduction in cross-sectional area in the alpha-beta region experienced by the billet after the earlier beta region forging and recrystallization. FIG. 6 shows this relation schematically. Where there is no or little alpha-beta region reduction (i.e., low work of from 0 to about 40 percent reduction in area) in the fourth-forging step, the microstructure includes prior beta grains and/or aligned alpha colonies. The interfaces are randomly shaped and oriented. The result is that sound energy introduced during ultrasonic testing is randomly scattered and does not exhibit high noise. However, the resulting structure also has limited ductility. If there is a relatively small reduction in area in the final alpha-beta forging, more than about 5 percent, the desirable microstructure is largely retained, with the associated low noise in subsequent ultrasonic testing, and the ductility is increased sufficiently to allow easy handling in subsequent processing operations. With increasing alpha-beta forging, the ultrasonic noise in subsequent testing increases. Desirably, the reduction in area is less than about 15 percent. However, the reduction in area may be as high as about 40 percent with a satisfactory noise level in the subsequent ultrasonic testing. At higher reductions in cross sectional area in the fourth step alpha-beta forging (i.e., intermediate work of more than about 40 percent but less than about 85 percent reduction in area), the microstructure develops elongated prior beta grains and/or aligned alpha colonies. There are planar interfaces which are perpendicular to the direction of sound propagation. Consequently, sound energy is reflected directly back to the ultrasonic transducer resulting in high noise. With even greater reductions in area (i.e., high working of more than about 85 percent reduction in area), recrystallization causes evidence of prior beta grains and/or aligned alpha colonies to be largely erased (illustrated by elongated, dashed lines in the inset of FIG. 6), producing a randomized crystal structure. There are few substantial interfaces in the structure to reflect sound energy, and as a result the noise in ultrasonic testing is relatively low. This approach, however, results in a small-size billet due to the required large reduction in area, and is therefore operable for only relatively small final articles.

Optionally, the billet, if its quality is determined to be acceptable in step 34 and by other analysis techniques, is further beta processed by working with at least one operation performed at a temperature above the beta-transus 42, numeral 36. This working step 36 may be performed after the third forging 26 (if the fourth forging step 30 is omitted) or after the fourth forging step 30. This beta-processing step 36 is not required, but the greatest advantages of the invention are realized with billet that is given such a final beta processing, step 36.

The invention has been reduced to practice using as a starting material an ingot of Ti-17 material. The billet was thereafter ultrasonically tested. Significantly lower levels of ultrasonic noise were experienced during the ultrasonic inspection of the resulting billet, as compared to the results for alternative approaches.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for processing a starting workpiece of a titanium-base alloy, comprising the steps of:

providing a starting workpiece of a titanum-base alloy having a temperature-composition phase diagram with a beta region and an alpha-beta region separated by a beta transus temperature;

first forging the starting workpiece at a first temperature above the beta transus temperature in the beta region to form a billet; thereafter second forging the billet at a second temperature below the beta transus temperature in the alpha-beta region; thereafter third forging the billet at a third temperature above the beta transus temperature in the beta region; and thereafter ultrasonic testing the billet, there being no heat treatment after the step of third forging and before the step of ultrasonic testing.

2. The method of claim 1, wherein the starting workpiece is an as-cast ingot.

3. The method of claim 1, wherein the starting workpiece is in an as-cast-plus-worked form.

4. The method of claim 1, further including an additional step, after the step of third forging, of quenching the billet.

5. The method of claim 1, further including an additional step, after the step of third forging, of annealing the billet.

6. The method of claim 1, further including an additional step, after the step of third forging, of working the billet at a temperature above the beta-transus temperature.

7. A method for processing a starting workpiece of a titanium-base alloy, comprising the steps of:

providing a starting workpiece of a titanum-base alloy having a temperature-composition phase diagram with a beta region and an alpha-beta region separated by a beta transus temperature;

first forging the starting workpiece at a first temperature above the beta transus temperature in the beta region to form a billet; thereafter second forging the billet at a second temperature below the beta transus temperature in the alpha-beta region; thereafter third forging the billet at a third temperature above the beta transus temperature in the beta region; and thereafter fourth forging the billet at a fourth temperature below the beta transus temperature in the alpha-beta region, with a reduction in cross-sectional area from more than 0 to about 40 percent.

8. The method of claim 7, wherein the step of fourth forging accomplishes a reduction in cross-sectional area of from about 5 to about 40 percent.

9. The method of claim 7, wherein the step of fourth forging accomplishes a reduction in cross-sectional area of from about 5 to about 15 percent.

10. The method of claim 7, further including an additional step, after the step of third forging, of quenching the billet.

11. The method of claim 7, further including an additional step, after the step of fourth forging, of annealing the billet.

12. The method of claim 7, further including an additional step, after the step of fourth forging, of ultrasonic testing the billet.

13. The method of claim 7, further including an additional step, after the step of fourth forging, of working the billet at a temperature above the beta-transus temperature.

14. A method for processing a starting workpiece of a titanium-base alloy, comprising the steps of:

providing a starting workpiece of a titanum-base alloy having a temperature-composition phase diagram with a beta region and an alpha-beta region separated by a beta transus temperature;

first forging the starting workpiece at a first temperature above the beta transus temperature in the beta region to form a billet; thereafter second forging the billet at a second temperature below the beta transus temperature in the alpha-beta region; thereafter third forging the billet at a third temperature above the beta transus temperature in the beta region; thereafter fourth forging the billet at a fourth temperature below the beta transus temperature in the alpha-beta region, wherein the step of fourth forging accomplishes a reduction in cross-sectional area of from about 0 to about 40 percent; and thereafter ultrasonic testing the billet.

15. The method of claim 14, further including an additional step, after the step of third forging, of quenching the billet.

16. The method of claim 14, wherein the step of fourth forging accomplishes a reduction in cross-sectional area of from about 5 to about 40 percent.

17. The method of claim 14, wherein the step of fourth forging accomplishes a reduction in cross-sectional area of from about 5 to about 15 percent.

18. The method of claim 14, further including an additional step, after the step of fourth forging, of annealing the billet.

19. The method of claim 14, further including an additional step, after the step of ultrasonic testing, of working the billet at a temperature above the beta-transus temperature.

20. A method for processing a starting workpiece of a titanium-base alloy, comprising the steps of:

providing a starting workpiece of a titanum-base alloy having a temperature-composition phase diagram with a beta region and an alpha-beta region separated by a beta transus temperature;

first forging the starting workpiece at a first temperature above the beta transus temperature in the beta region to form a billet; thereafter second forging the billet at a second temperature below the beta transus temperature in the alpha-beta region; thereafter third forging the billet at a third temperature above the beta transus temperature in the beta region; and thereafter ultrasonic testing the billet, there being no forging of the billet in the alpha-beta region after the step of third forging and before the step of ultrasonic testing.

* * * * *